United States Patent [19]

Hauschopp et al.

[11] 4,403,809

[45] Sep. 13, 1983

[54] MINERAL WINNING PLOUGH

[75] Inventors: Alois Hauschopp, Werne; Oswald Breuer, Dortmund; Bernd Steinkuhl, Lunen, all of Fed. Rep. of Germany

[73] Assignee: Gewerkschaft Eisenhutte Westfalia, Lunen, Fed. Rep. of Germany

[21] Appl. No.: 314,340

[22] Filed: Oct. 23, 1981

[30] Foreign Application Priority Data

Apr. 11, 1980 [DE] Fed. Rep. of Germany ..... 3041485

[51] Int. Cl.[3] ..... E21C 27/32

[52] U.S. Cl. ..... 299/34

[58] Field of Search ..... 299/34, 36, 42, 47, 299/43, 48

[56] References Cited

FOREIGN PATENT DOCUMENTS 2309820 8/1974 Fed. Rep. of Germany ..... 299/34

2559725 9/1977 Fed. Rep. of Germany ..... 299/34

*Primary Examiner*—William F. Pate, III

*Assistant Examiner*—Beverly E. Hjorth

*Attorney, Agent, or Firm*—Sughrue, Mion, Zinn, Macpeak and Seas

[57] ABSTRACT

A mineral winning plough, such as a coal plough, has a plough body adapted to be moved to and fro alongside a mineral face on a plough guide. The plough body is provided with a pair of vertically-adjustable carriers, each of which is provided with floor cutters. The plough body is provided with setting means for raising and lowering the carriers into rest and working positions respectively. The setting means comprises a slide plate, and an intermediate member. The slide plate is mounted in an aperture in the plough body for limited movement relative thereto. The slide plate is attachable to a plough drive chain. The intermediate member forms a mechanical operative connection between the slide plate and the two carriers. The intermediate member is rotatably mounted on the plough body, and is positioned between the two carriers. The arrangement is such that movement of the slide plate relative to the plough body in a given direction forces one of the carriers to be lowered into its working position, and causes the other carrier to be raised into its rest position.

22 Claims, 5 Drawing Figures

MINERAL WINNING PLOUGH

BACKGROUND TO THE INVENTION

This invention relates to a mineral winning plough, and in particular to a coal plough.

As is known, a coal plough is a machine which is movable to and fro on a guide alongside the face of a longwall working. The guide is usually attached to a scraper-chain conveyor, and the plough has a plough body provided with cutters which strip coal from the face. The plough is driven to and fro by means of an endless drive chain attached to the plough body. The plough body is provided with groups of cutters at each end thereof, so that coal can be won in each direction of plough travel. Such a coal plough is also provided, at each end thereof, with a vertically-adjustable floor cutter carrier. These floor cutter carriers support detachable floor cutters. The floor cutters are usually used fo control or stress-relieving purposes. Typically, such a coal plough is symmetrical with respect to its central, vertical transverse plane.

A known type of coal plough is provided with means for moving its groups of cutters and its floor cutters between working positions (in which the cutter win coal from a face) and rest positions (in which the cutters are spaced from the face and perform no winning action). In this way, it is possible to move the appropriate cutters into their working or rest positions to suit the direction of plough travel.

Known means for setting the positions of the floor cutter carriers are large and complicated, and may incorporate large and sensitive hydraulic setting rams. (See DE-OS 2 819 082).

The aim of the invention is to provide a mineral winning plough whose floor cutters can be positioned by a setting device that is simple and robust, and is of space-saving construction so as to be usable on ploughs of compact construction and relatively short length.

SUMMARY OF THE INVENTION

The present invention provides a mineral winning plough having a plough body adapted to be moved to and fro alongside a mineral face on a plough guide, the plough body being provided with a pair of vertically-adjustable carriers each of which is provided with floor cutter means, and the plough body being provided with setting means for raising and lowering the carriers into rest and working positions respectively, the setting means comprising a setting member and an intermediate member, the setting member being mounted on the plough body for limited movement relative thereto, and being attachable to a plough drive chain, and the intermediate member forming a mechanical operative connection between the setting member and the two carriers, wherein the intermediate member is rotatably mounted on the plough body and is positioned between the two carriers, the arrangement being such that movement of the setting member relative to the plough body in a given direction forces one of the carriers to be lowered into its working position, and causes the other carrier to be raised into its rest position.

With this form of setting means, it is possible to set both floor cutter carriers simultaneously (and in opposite directions) in a simple mechanically-positive way. Thus, for each direction of plough travel, one of the floor cutter carriers is lowered into its working position, and the other floor cutter carrier is raised into its rest position. Moreover, both carriers are held firmly in these positions during the subsequent winning operation.

Advantageously, the setting member is slidably mounted in an aperture in the plough body, the setting member being movable to and fro within the aperture in directions which correspond to the two directions of travel of the plough. Preferably, the aperture housing the setting member is open towards the base of the plough body.

Conveniently, the arrangement is such that, when each carrier is in its working position, it is the trailing carrier with respect to the direction of travel of the plough.

Advantageously, the intermediate member is mounted on the plough body for rotational movement about a fixed shaft whose axis extends at right-angles to the directions of movement of the plough. Preferably, the fixed shaft is disposed on the central vertical transverse plane of the plough body, and the plough body is symmetrical with respect to its central vertical transverse plane. Thus, the setting means utilises a simple mechanical link (the intermediate member) which is actuated by the setting member which, in turn, is moved by the plough drive chain whenever the plough changes direction. Consequently, sensitive and large hydraulic setting rams are not necessary; and the entire setting means is relatively simple and compact, so that it can be accommodated on the plough body even if this is relatively short.

In a preferred embodiment, the intermediate member is a rocker arm, one end of the rocker arm being attached to the setting member, and the other end of the rocker arm being positioned between first ends of two elongate slide plates, the slide plates being slidably mounted in respective guides formed in the plough body, the carriers being attached to the opposite ends of the slide plates to said first ends. Advantageously, the rocker arm is pivotably mounted on the plough body, and said one end of the rocker arm is attached to the setting member by means of a pivot pin and a hinge piece. Preferably, the other end of the rocker arm is T-shaped, the opposite ends of the T constituting stop faces which cooperate with said first ends of the slide plates. Conveniently, each of the slide plate guides is positioned to lie in a vertical longitudinal plane of the plough body and at an acute angle to the base of the plough body. In this case, each of the carriers may be constituted by a double-armed lever, one arm of each lever carrying the respective floor cutter means, and the other arm of that lever being attached to the plough body by a respective slide guide. Each slide guide may be arcuate, and may be constituted by a fixed guide pin attached to the plough body, and an arcuate guide slot formed in said other arm of the respective double-armed carrier. Preferably, the first ends of the two slide plates are interconnected by a tie bar. In order to vary the height settings of the floor cutter carriers, a respective rotatable stop may be provided on the plough body for each of the slide plates, each of the rotatable stops being provided with a plurality of stop faces, each of which is engageable with the respective slide plate to limit the downward movement of that slide plate within its guide.

In another preferred embodiment, the intermediate member is a toothed wheel, the toothed wheel engaging a rack provided on the setting member. In this case, the two carriers may be provided at the opposite ends of an arcuate slide plate, the arcuate slide plate being slidably mounted in an arcuate guide formed in the plough body, and the toothed wheel engaging a rack provided on the arcuate slide plate. Advantageously, the arcuate guide is disposed in a longitudinal vertical plane of the plough body.

Conveniently, the setting member is provided with a projection, the projection being adapted to extend into the lower chain duct of a plough guide, and being provided with connectors for the connection of a plough drive chain. Advantageously, the plough body is provided with a pair of projections, said pair of projections being positioned on opposite sides of the projection provided on the setting member, and being adapted to extend into the lower chain duct of a plough guide, said projections constituting means for guiding the plough along the plough guide.

Preferably, the plough body is provided, at each end thereof, with further carriers, each of which is provided with a plurality of cutters. Conveniently, each of said further carriers is pivotably mounted on the plough body and is movable between rest and working positions by the setting means provided for the first-mentioned carriers.

BRIEF DESCRIPTION OF THE DRAWINGS

Two forms of coal plough, each constructed in accordance with the invention, will now be described, by way of example, with reference to the accompanying drawings, in which.

DESCRIPTION OF PREFERRED EMBODIMENTS

Figure 1:
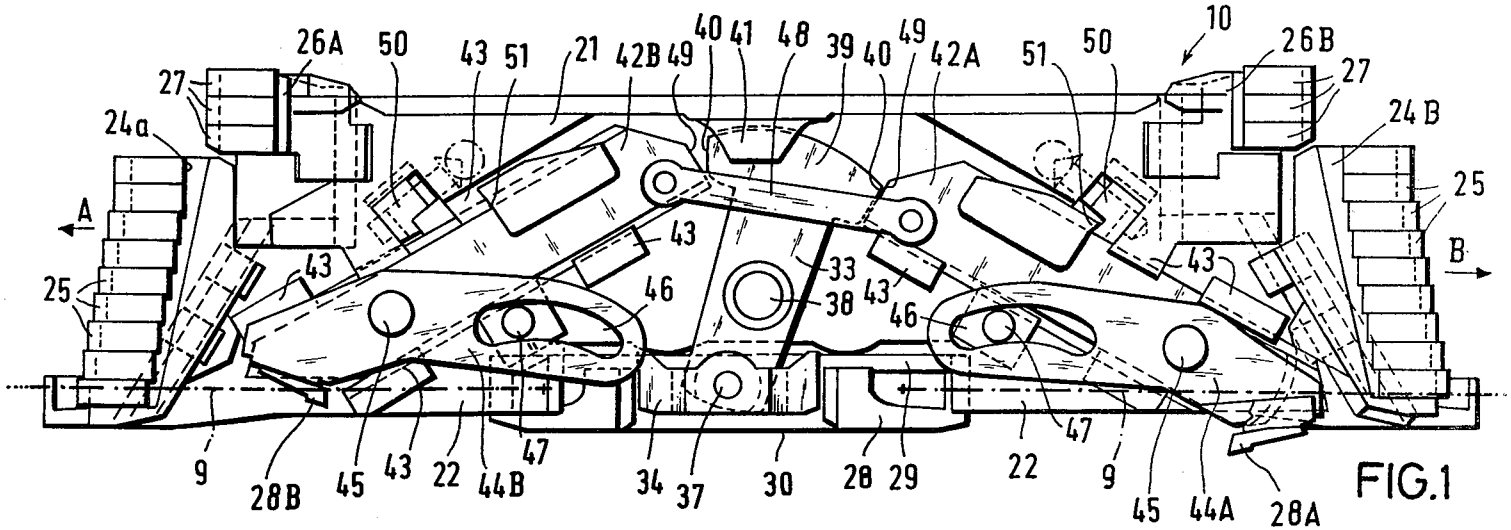
FIG. 1 is a front elevation of the first form of plough.
Figure 3:
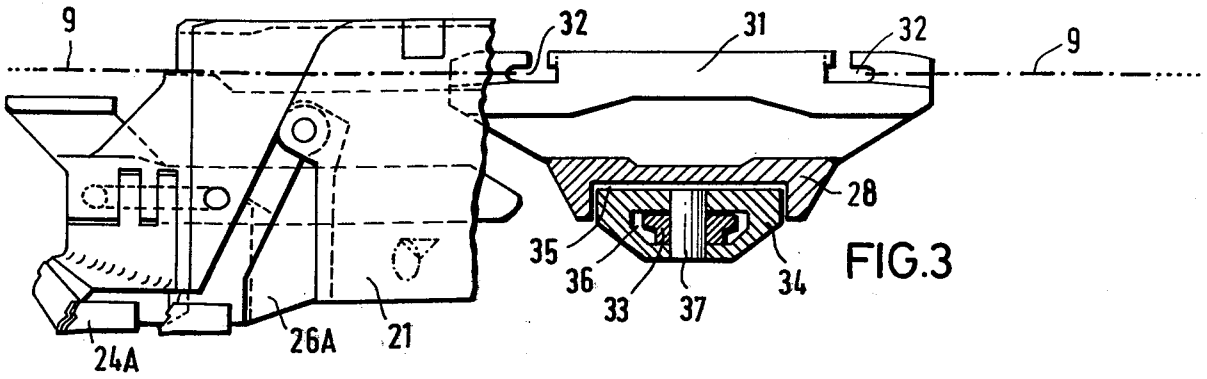
FIG. 3 is a part-sectional plan view of part of the plough of FIGS. 1 and 2.
Figure 4:
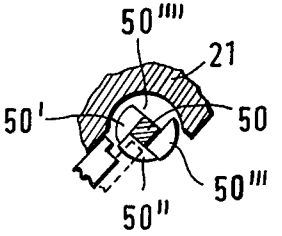
FIG. 4 shows on a larger scale, a stop member used in the plough of FIGS. 1 to 3.
Figure 2:
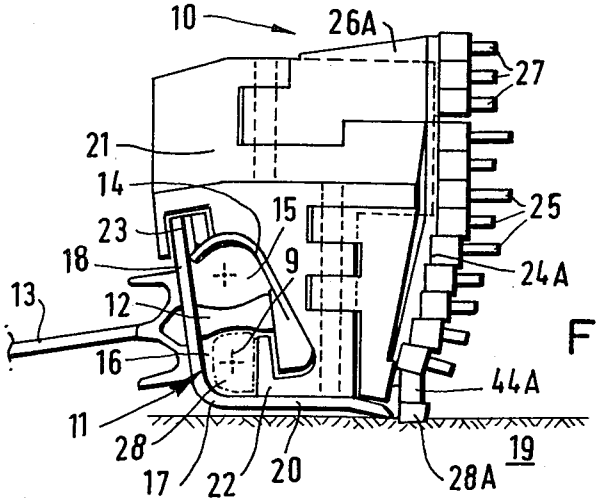
FIG. 2 is an end elevation of the plough of FIG. 1.

Referring to the drawings, FIGS. 1 to 4 shows a coal plough 10 which is movable to and fro along a guide 11 fixed to the face side of a longwall scraper-chain conveyor 13 (see FIG. 2). The guide 11 has a ramp-like cover plate 14 which is detachably secured to an L-shaped plate 17 by means of slidable spacers 12. The plate 17 has an upright arm 18 fixed to the face side of the conveyor 13, and a floor plate 20 which forms a slide track for the plough 10 and rests on the floor 19 of the longwall working. The floor plate 20 also regulates, in known manner, the cutting depth of the plough 10. The cover plate 14, the L-shaped plate 17, and the spacers 12 define upper and lower chain ducts 15 and 16 respectively which house an endless drive chain 9 for the plough 10. As is usual, the L-shaped plate 17 and the cover plate 14 are formed in sections, these sections corresponding to the channel sections (pans) of the scraper-chain conveyor 13.

The plough 10 is of symmetrical construction on either side of its vertical transverse central plane. This enables the plough 10 to win coal equally well in either of its two directions A and B of travel. The plough 10 has a one-piece plough body 21 which is shaped to engage over, and slide upon, the guide 11. The plough body 21 is provided, at each side of its vertical transverse central plane, with respective guide arms 22 (see FIG. 2). The guide arms 22 extend into the lower chain duct 16 (which accommodates the traction run of the drive chain 9), and hook around the lower edge of the cover plate 14, so as to guide the lower portion of the plough body 21. The upper portion of the plough body 21 is guided by a guide arm 23 formed at the upper end of the upright arm of the L-shaped plate 17. The upper portion of the plough body 21 hooks over the guide arm 23 so as the guide the plough 10 in a positive manner.

Disposed in a mirror-image arrangement at the two ends of the plough body 21 are groups 24A and 24B of main cutters 25. Above these groups 24A and 24B are arranged groups 26A and 26B of upper cutters 27. The cutters 25 of each of the groups 24A and 24B, and the cutters 27 of each of the groups 26A and 26B are arranged in echelon formation one above the other. Each group 24A and 24B, 26A and 26B is mounted on a respective carrier pivotably mounted on the plough body 21 for movement towards, and away from, the coal face (not shown). Thus, each group 24A, 24B, 26A and 26B can be pivoted from a working position, in which their cutters 25 or 27 win coal from the face, to a rest position, in which their cutters perform no winning operations. The groups 24A and 26A are used to win coal when the plough 10 moves in the direction A, and the groups 24B and 26B are used to win coal when the plough moves in the direction B.

The plough 10 is also provided with a pair of floor cutters 28A and 28B, the floor cutters being disposed in a mirror-image arrangement at the two end portions of the plough body 21. The floor cutters 28A and 28B are mounted on the plough body 21 so as to be vertically adjustable. Thus, when the plough 10 moves in the direction A, the floor cutter 28A (which is positioned at the trailing end of the plough body 21) is lowered into the working position, and the floor cutter 28B (which is positioned at the leading end of the plough body) is raised into the rest position. When the plough 10 moves in the direction A, the cutter groups 24A and 26A are also moved into their working positions, whereas the cutter groups 24B and 26B are in their rest positions. Similarly, when the plough 10 moves in the direction B, the floor cutter 28B and the cutter groups 24B and 26B are moved into their working positions, and the floor cutter 28A and the cutter groups 24A and 26A are moved into their rest positions.

The floor cutters 28A and 28B are positioned in their rest or working positions by means of a setting device having a slide plate 28 which is slidably mounted in an aperture 29 formed in the middle portion of the plough body 21. The slide plate 28 is slidable, to a limited extent, in the directions A and B of plough movement. The lower face 30 of the slide plate 28 slides on the upper surface of the floor plate 20, and the aperture 29 is positioned between the two guide arms. The slide plate 28 is provided with a coupling member 31 (see FIG. 3) which extends into the lower chain duct 16. The coupling member 31 is provided with two connectors 32, to which the ends of the drive chain 9 are connected.

When the plough 10 changes its direction of travel, the slide plate 28 is moved relative to the plough body 21 (in a manner described below). This movement is transmitted, via a rocker arm 33 and a hinge piece 34, to the floor cutters 28A and 28B. The hinge piece 34 lies in a recess 35 formed in the slide plate 28 (see FIG. 3), and has an internal cavity 36 into which the rocker arm 33 extends. The rocker arm 33 is pivotably attached to the hinge piece 34 by means of a pivot pin 37. The axis of the pivot pin 37 extends horizontally and at right-angles to the coal face. Above this pivotal connection, the rocker arm 33 is pivotably connected to the plough body 21 by means of a pivot pin 38. The pivot pin 38 is positioned in the vertical transverse central plane of the plough body 21, and its axis is parallel to that of the pivot pin 37. The rocker arm 33 has a hammer-head end portion 39, which has a pair of stop faces 40 symmetrically arranged at the opposite ends thereof. The end portion 39 of the rocker arm 33 is guided on a guide tongue 41 provided at the rear of the plough body 21.

The rocker arm 33 cooperates with a pair of slide plates 42A and 42B. The slide plates 42A and 42B are symmetrically disposed with respect to the vertical transverse central plane of the plough body 21, and are slidable within straight guides 43 formed in the plough body. The guides 43 are positioned in a plane parallel to that of the coal face, and each extends at an acute angle to the floor of the working. Floor cutter carriers 44A and 44B are pivotably mounted, by means of pivot pins 45, at the lower ends of the slide plates 42A and 42B respectively. The floor cutters 28A and 28B are releasably secured to their carriers 44A and 44B respectively for ease of replacement. The axes of the pivot pins 45 are parallel to those of the pivot pins 37 and 38. Each of the carriers 44A and 44B is constituted by a double-armed lever, the arms of which extend at a relatively large obtuse angle to one another (see FIG. 1). The shorter arm of each of the carriers 44A and 44B carries the respective floor cutters 28A or 28B, and their longer arms are guided on the plough body 21 by means of arcuate guides 46,47. Each of the arcuate guides has an arcuate slot 46 formed in the respective carrier longer arm, and a guide pin 47 fixed to the plough body 21. The centre of carvature of each of the arcuate slots 46 is located beneath the floor of the working. The upper ends of the two slide plates 42A and 42B are interconnected by a tie bar 48, the two ends of which are pivotably attached to said upper ends. The upper ends of the slide plates 42A and 42B are also formed with stop faces 49, which cooperate with the stop faces 40 on the end portion 39 of the rocker arm 33.

The plough body 21 carries a respective stop member 50 for each of the slide plates 42A and 42B. Each of the stop members 50 is a rotatable cam which limits the downward movement of the associated slide plate 42A or 42B in its guide 43. Each stop member 50 has four stop faces 50', 50'', 50''' and 50'''' (see FIG. 4), and each of the stop members 50 is eccentrically mounted on the plough body 21 in such a manner that any one of its stop faces can be brought into alignment with a stop face 51 provided on the associated slide plate 42A or 42B. In this way, it is possible to set the floor cutters 28A and 28B in four vertically-spaced positions. The stop members 50 are mounted in apertures (not shown) in the plough body 21, these apertures being accessible from the goaf side of the plough 10. Thus, a special tool can be used to turn the stop members 50, so that the floor cutters 28A and 28B can be set in any one of four cutting height positions.

When the plough 10 begins to move in the direction A, the slide plate 28 is moved, by the plough drive chain 9, along the aperture 29. This movement of the slide plate 28 relative to the plough body 21 pivots the rocker arm 33 in the clockwise direction. Thus, the stop face 40 of the end portion 39 of the rocker arm 33 engages the stop face 49 of the slide plate 42A. Further movement of the slide plate 28 within the aperture 29 causes further clockwise movement of the rocker arm 33, and hence displacement of the slide plate 42A downwards within its guide 43. Thus, the floor cutter carrier 44A is lowered to position the floor cutter 28A in its working position, the height of which is determined by which of the stop faces 50',50'', 50''' and 50'''' is aligned with the stop face 51. During this setting movement, the carrier 44A is guided in a precise manner by means of its arcuate guide 46, 47. Moreover, during this setting movement, the other slide plate 42B is slid upwards within its guide 43 by the tie bar 48. Thus, the floor cutter 28B is lifted into its rest position as the floor cutter 28A is lowered into its working position. This ensures that the floor level region of the face is won by the floor cutter 28A which trails the cutters 25 and 27 which do the main winning work. Once the floor cutters 28A and 28B are positioned respectively in their working and rest positions, the slide plate 28 engages a stop face defined by the right-hand end of the aperture 29. The movement of the drive chain 9 is then transmitted to the plough body 21 to move the plough 10 in the direction A.

When the plough 10 is reversed, to travel in the direction B, the floor cutter 28A is raised into its rest position (and the floor cutter 28B is lowered into its working position) by the movements of the slide plate 28, the rocker arm 33 and the slide plates 42A and 42B. The cutter groups 24A, 24B, 26A and 26B can be positioned in their working and rest positions in any known manner. Preferably, however, they are coupled to the positive-displacement device (that is to say the rocker arm 33 and the slide plates 42A and 42B) which is used to set the floor cutters 28A and 28B.

Figure 5:
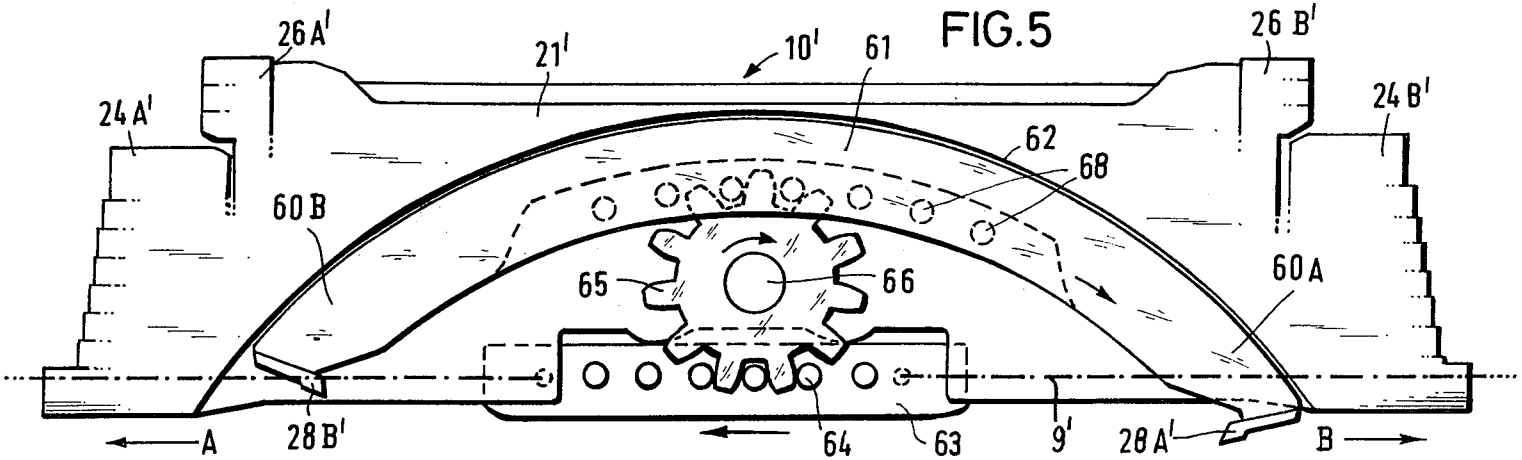
FIG. 5 is a diagrammatic front elevation of the second form of plough.

FIG. 5 shows a coal plough 10' having a modified form of setting means for its floor cutters 28A' and 28B'. The plough 10' is basically the same as the plough 10, so only the modified setting means will be described in detail. As with the embodiment of FIGS. 1 to 4, the plough 10' has a plough body 21' which is provided with symmetrically-disposed cutter groups 24A', 24B' and 26A', 26B'. The floor cutters 28A' and 28B' are, however, mounted in carriers 60A and 60B fixed to the opposite ends of an arcuate slide plate 61. Alternatively, the carriers 60A and 60B are formed integrally with the slide plate 61. In either case, the floor cutters 28A' and 28B' are releasably secured to their carriers 60A and 60B respectively for ease of replacement. The arcuate slide plate 61 is slidably mounted in an arcuate guide 62 formed in the plough body 21. The centre of curvature of the arcuate guide 62 is located beneath the floor of the working. The arcuate slide plate 61 is of such a length that, when one of the floor cutters 28A' or 28B' is positioned in its working position adjacent to the floor of the working, the other floor cutter 28B' or 28A' is in its rest position (that is to say it is raised with respect to the floor of the working).

The floor cutters 28A' and 28B' are positioned in their rest or working positions by means of a setting device having a slide plate 63, which is similar to the slide plate 28 of the embodiment of FIGS. 1 to 4 in that it is slidably mounted in an aperture formed in the face side of the plough body 21'. Moreover, the slide plate 63 is attached to the plough drive chain 9' located in the lower chain duct of the plough guide (not shown). In place of the rocker arm 33 of the embodiment of FIGS. 1 to 4, the setting device of FIG. 5 has a toothed wheel 65 mounted on the plough body 21'. The toothed wheel 65 meshes with racks 64 and 68 provided respectively on the slide plate 63 and on the slide plate 61. The drive wheel 65 is rotatably mounted on the plough body 21' by means of a pin 66 whose axis extends at right-angles to the coal face. The arrangement is such that movement of the slide plate 63 in the direction A causes the toothed wheel 65 to rotate in a clockwise direction. This causes the arcuate slide plate 63 to slide in a clockwise direction along its guide 64, so that the floor cutter 28A' is lowered into its working position, and the floor cutter 28B' is raised into its rest position. Similarly, when the slide plate 63 moves in the direction B, the floor cutter 28A' is raised into its rest position, and the floor cutter 28B' is lowered into its working position. As with the embodiment of FIGS. 1 to 4, the movements of the slide plate 63 relative to the plough body 21' are initiated by the plough drive chain 9' each time the plough 10' changes direction.

We claim:

1. A mineral winning plough having a plough body adapted to be moved to and fro alongside a mineral face on a plough guide, the plough body being provided with a pair of vertically-adjustable carriers each of which is provided with floor cutter means, and the plough body being provided with setting means for raising and lowering the carriers into rest and working positions respectively, the setting means comprising a setting member and an intermediate member, the setting member being mounted on the plough body for limited movement relative thereto, and being attachable to a plough drive chain, and the intermediate member forming a mechanical operative connection between the setting member and the two carriers, wherein the intermediate member is rotatably mounted on the plough body and is positioned between the two carriers, the arrangement being such that movement of the setting member relative to the plough body in a given direction forces one of the carriers to be lowered into its working position, and causes the other carrier to be raised into its rest position.

2. A plough according to claim 1, wherein the setting member is slidably mounted in an aperture in the plough body, the setting member being movable to and fro within the aperture in directions which correspond to the two directions of travel of the plough.

3. A plough according to claim 1, wherein the arrangement is such that, when each carrier is in its working position, it is the trailing carrier with respect to the direction of travel of the plough.

4. A plough according to claim 1, wherein the intermediate member is mounted on the plough body for rotational movement about a fixed shaft whose axis extends at right-angles to the directions of movement of the plough.

5. A plough according to claim 4, wherein the fixed shaft is disposed on the central vertical transverse plane of the plough body.

6. A plough according to claim 1, wherein the plough body is symmetrical with respect to its central vertical transverse plane.

7. A plough according to claim 1, wherein the intermediate member is a rocker arm, one end of the rocker arm being attached to the setting member, and the other end of the rocker arm being positioned between first ends of two elongate slide plates, the slide plates being slidably mounted in respective guides formed in the plough body, the carriers being attached to the opposite ends of the slide plates to said first ends.

8. A plough according to claim 7, wherein the rocker arm is pivotably mounted on the plough body.

9. A plough according to claim 7, wherein said one end of the rocker arm is attached to the setting member by means of a pivot pin and a hinge piece.

10. A plough according to claim 7, wherein the other end of the rocker arm is T-shaped, the opposite ends of the T constituting stop faces which cooperate with said first ends of the slide plates.

11. A plough according to claim 7, wherein each of the slide plate guides is positioned to lie in a vertical longitudinal plane of the plough body and at an acute angle to the base of the plough body.

12. A plough according to claim 11, wherein each of the carriers comprises a double-armed lever, one arm of each lever carrying the respective floor cutter means, and the other arm of that lever being attached to the plough body by a respective slide guide.

13. A plough according to claim 12, wherein each slide guide is arcuate.

14. A plough according to claim 13, wherein each arcuate slide guide comprises a fixed guide pin attached to the plough body, and an arcuate guide slot formed in said other arm of the respective double-armed carrier.

15. A plough according to claim 7, wherein the first ends of the two slide plates are interconnected by a tie bar.

16. A plough according to claim 7, wherein a respective rotatable stop is provided on the plough body for each of the slide plates, each of the rotatable stops being provided with a plurality of stop faces, each of which is engageable with the respective slide plate to limit the downward movement of that slide plate within its guide.

17. A plough according to claim 1, wherein the intermediate member is a toothed wheel, the toothed wheel engaging a rack provided on the setting member.

18. A plough according to claim 17, wherein the two carriers are arranged at the opposite ends of an arcuate slide plate, the arcuate slide plate being slidably mounted in an arcuate guide formed in the plough body, and wherein the toothed wheel engages a rack provided on the arcuate slide plate.

19. A plough according to claim 18, wherein the arcuate guide is disposed in a longitudinal vertical plane of the plough body.

20. A plough according to claim 2, wherein the aperture housing the setting member is open towards the base of the plough body.

21. A plough according to claim 1, wherein the setting member is provided with a projection, the projection being adapted to extend into the lower chain duct of a plough guide, and being provided with connectors for the connection of a plough drive chain.

22. A plough according to claim 21, wherein the plough body is provided with a pair of projections, said pair of projections being positioned on opposite sides of the projection provided on the setting member, and being adapted to extend into the lower chain duct of a plough guide, said projections constituting means for guiding the plough along the plough guide.

* * * * *